US006608271B2

(12) United States Patent
Duarte

(10) Patent No.: US 6,608,271 B2
(45) Date of Patent: Aug. 19, 2003

(54) METHOD OF DYNAMICALLY LIGHTING KEYBOARD GLYPHS

(75) Inventor: Matias G. Duarte, San Francisco, CA (US)

(73) Assignee: Danger, Inc., Palo Alto, CA (US)

( * ) Notice: Subject to any disclaimer, the term of this patent is extended or adjusted under 35 U.S.C. 154(b) by 0 days.

(21) Appl. No.: 09/932,195

(22) Filed: Aug. 17, 2001

(65) Prior Publication Data

US 2003/0034240 A1 Feb. 20, 2003

(51) Int. Cl.[7] ..... H01H 9/16

(52) U.S. Cl. ..... 200/311; 200/310; 200/313; 200/314

(58) Field of Search ..... 200/308–314; 340/815.48, 815.53, 815.55, 815.56, 815.75; 341/20–23; 362/95, 277, 280–284, 293, 295, 319, 322–324

(56) References Cited

U.S. PATENT DOCUMENTS

| | | | | | |
|---|---|---|---|---|---|
| 4,501,937 | A | * | 2/1985 | Anderson et al. | 200/5 A |
| 4,987,279 | A | * | 1/1991 | Hirose et al. | 200/314 |
| 5,040,479 | A | * | 8/1991 | Thrash | 116/279 |
| 5,642,929 | A | * | 7/1997 | Ushimaru | 362/85 |
| 5,950,809 | A | * | 9/1999 | Andre | 200/314 |
| 5,951,150 | A | * | 9/1999 | Helstern | 362/293 |
| 6,207,913 | B1 | * | 3/2001 | Nakajima et al. | 200/314 |
| 6,210,010 | B1 | * | 4/2001 | Pontetti et al. | 362/24 |

* cited by examiner

*Primary Examiner*—Michael Friedhofer
(74) *Attorney, Agent, or Firm*—Blakely, Sokoloff, Taylor & Zafman LLP

(57) ABSTRACT

In one embodiment a light source is provided to illuminate one or more keys. Each key has at least one glyph. The color of each glyph corresponds to the light source.

39 Claims, 10 Drawing Sheets

METHOD OF DYNAMICALLY LIGHTING KEYBOARD GLYPHS

FIELD OF THE INVENTION

The present invention relates generally to the field of input devices. More particularly, the present invention relates to any human-machine interface for operating devices that use keys.

BACKGROUND

The popularity and use of personal computers (PCs), digital assistants (PDAs), wireless telephones, extended function pagers and other compact computing devices has increased in recent years. A typical PDA or hand-held computer is primarily a lightweight, compact communication tool that can typically be held in one hand, leaving the other free to input data with a pen type stylus on a touch sensitive screen or keyboard. The keyboard may be integrated into the device or attached externally. Many wireless telephones and pagers have expanded capabilities beyond the original intended use to include storing and retrieving numbers, messages, emails, and accessing the Internet.

Many compact and portable computing devices use an abbreviated and/or compact keyboard to input data and select functions. In the case of PDAs, the keyboard is generally several times the size of the PDAs, attaches externally, and offers similar functionality to that of a standard PC keyboard. A key is typically labeled with a primary function (i.e., the numeric character "1") and a secondary function (i.e., the character "!"). To access the secondary function a user must change the mode for the keyboard such as by holding down a shift or control key while depressing the key corresponding to the secondary function. Additionally, most keyboards include a shift lock that locks the keyboard in the secondary function mode. Often, a keyboard has a single lighted (i.e., LED) indicator showing the current mode of the keyboard, for example, a "Caps Lock" indicator. Some compact computing devices can indicate the keyboard's current mode on the device's display.

A problem arises when a compact computing device requires substantially all of the functions of a full size PC keyboard but has a limited area for keys. One approach to include substantially all of the functions of a full size PC keyboard is to require a single key to have four or more functions (i.e., four or more functional modes). Unfortunately, providing four or more functional modes requires some method of selecting and indicating the mode to the user. One indicating method requires the user to search for a function indicator on the keyboard and/or on the display to accurately determine the current mode of the keyboard to ensure accurate data entry.

Another approach is to use a virtual keyboard. A virtual keyboard is a graphical representation of a typical full-size PC keyboard, or a portion thereof, that when touched inputs the corresponding character into a portion of the display area. The user can also select other virtual keyboards (i.e., other portions of a typical full-size keyboard) such as a numeric or symbol keypad. The virtual keyboard approach consumes a large portion of an already limited display area with the virtual keys and thus limits the user's ability to view and edit entered text.

SUMMARY OF THE INVENTION

In one embodiment a light source is provided to illuminate one or more keys. Each key has at least one glyph. The color of each glyph corresponds to the light source.

BRIEF DESCRIPTION OF THE DRAWINGS

The present invention is illustrated by way of example, and not limitation, in the figures of the accompanying drawings in which.

DETAILED DESCRIPTION

As will be described in more detail below, a system and method for highlighting a selected glyph on a key, or multiple keys of a keyboard are described. One embodiment includes multiple translucent keys, each key has an opaque top layer. Each key also has multiple glyphs located in the top layer. Each of the glyphs is translucent and has a color different from the other glyphs. A light source is also included. The light source illuminates the perimeter of the keyboard such that light passes laterally through keys at the perimeter of the keyboard and into adjacent keys. A light source selector is also included. The light source selector selects the wavelength of light emitted from the light source or sources such that the selected wavelength corresponds to a selected glyph on the key. In one embodiment, the light source selected increases the selected glyph's contrast with respect to the remaining glyphs, which thereby makes the selected glyph more visible to a user.

Alternatively, a light source is included under the keyboard and illuminates the bottom of keys such that light passes through the bottom side of the keys and conducts out the remaining sides to adjacent keys.

In various embodiments described herein, the key may be part of a cellular phone, a pager, a numerical keypad, a remote control device (e.g., television remote), a handheld PDA, or other computing device that utilizes a keyboard. Accordingly, the examples of highlighting a glyph on a key presented below should be regarded as illustrative only and should in no way be seen as limiting the broader scope of the present invention. Although only compact and portable devices are discussed herein, the present invention can also be implemented on any type or size keyboard where multifunction keys are used.

Figure 1:
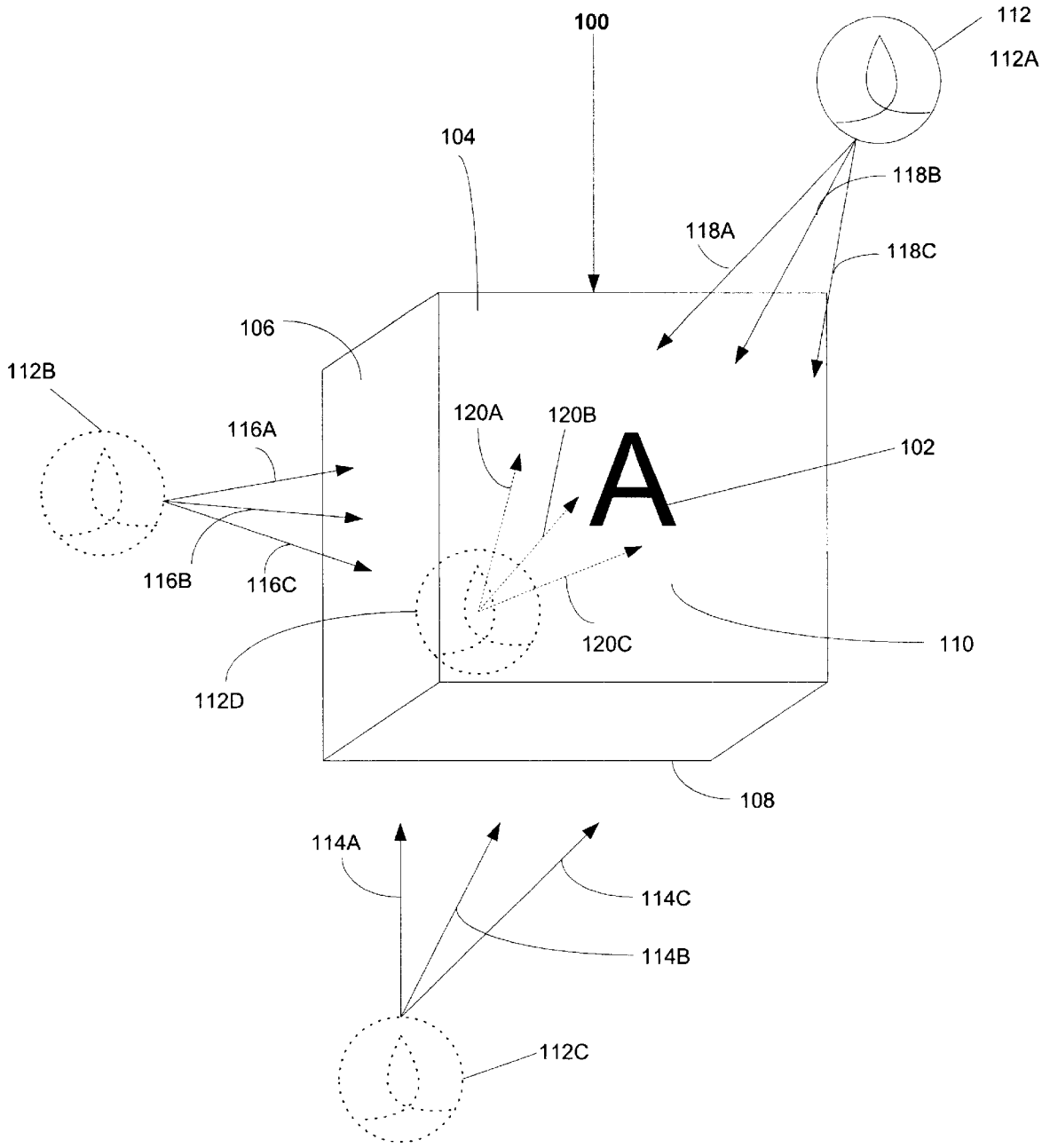
FIG. 1 illustrates one illustrates one embodiment of a key.

FIG. 1 illustrates one embodiment of a key. The key 100 includes a glyph 102, which is visible to a user who can select (i.e., press) the key 100. The glyph 102 can be located on the top surface 104 of key 100 in one embodiment. A light source 112 is also included. The light source 112 has the characteristics of intensity, wavelength, and location with respect to the keys. The light source can be a wavelength within or outside the visible spectrum (i.e., infra-red, a wavelength of 1 to 100 micrometers), of varying intensities, and in any one of several locations (i.e., such as locations 112A, 112B, 112C, 112D as shown), or any combinations thereof.

Aspects of the glyph 102 can include a color, a fluorescent material or other photo reactive material, or the glyph 102 can be transparent, translucent or opaque or a combination thereof. The glyph 102 can also be located on the top surface 104, in the top surface 104, or under the top surface 104 such that in any embodiment the glyph is visible to a user. In one embodiment, the glyph 102 is translucent, or alternatively transparent, and located in the top surface 104 such that light from the light source 112 can be conducted through the key 100 and outward from the top surface 104 of the key 100 so that the glyph 102 is lit and/or highlighted by the light so that the user can more easily see the glyph 102. In various embodiments the top surface 104 can also have a color, or be opaque, translucent, or transparent and the top surface 104 can have a smooth reflective surface or a non-reflective matt surface or combinations thereof.

In one embodiment, the key 100 and/or the glyph 102 can include a material that fluorescences (glows) when illuminated by a light source. Fluorescence is the phenomenon in which absorption of light of a given wavelength by a fluorescent material is followed by the emission of light at a different wavelength, usually in the visible range. Therefore, the key 100 and/or glyph 102 will emit visible light and be lit and/or highlighted such that there is an increase in contrast of the glyph 102 so that the user can more easily see the glyph 102.

In another embodiment, the key 100 can have a color, be translucent, or alternatively, transparent or opaque or combinations thereof. For example, in one embodiment, a transparent key 100 is lit from the bottom surface 108 or a side (i.e., side 106) such that light conducts out the remaining sides, through the bottom of the key 100, and is emitted through the transparent or translucent glyph 102 such that the user can more easily see the lighted glyph. A translucent key 100 may be desirable because light directed toward the key 100 from the bottom 108 or a side (i.e., side 106) is diffused such that the light emits more evenly out the remaining sides and through the glyph 102. A translucent or transparent key 100 can also emit light from each side (i.e., side 106) to an adjacent key, thereby lighting the adjacent key. In this manner light may be emitted laterally from one key to the next so that an entire line of keys is lighted by a light source at the beginning of the line of keys.

Light source 112 can include any type of light source known in the art such as, various colored LEDs, an incandescent, fluorescent, ultraviolet, infrared, or laser light source or combinations thereof. The light source 112 can also include a wavelength selector such as color filters, gratings or other methods of wavelength selection common in the art. The light source 112 can also include multiple light sources and/or multiple colors. In one embodiment, the light source 112 can be located in position 112B (i.e., directed toward any side, such as side 106) such that the side of the key 100 is illuminated. The light rays 116A, 116B, and 116C are directed toward the side surface 106, pass through the key 100, and exit the remaining sides, the bottom surface 108, and the top surface 104. The portion of the light passing through the top surface 104 also illuminates the glyph 102.

In another embodiment, the light source 112 is located in position 112C illuminating the bottom surface 108 of the key 100. The light rays 114A, 114B, and 114C are directed toward the bottom surface 108, pass through the key 100, and exit the sides (i.e., side 106) and the top surface 104 thereby illuminating the glyph 102 as described above. Similarly, the light source 112 can illuminate the key 100 and the glyph 102 from within the key such as in location 112D (i.e., inside the key 100). The light rays 120A, 120B, and 120C radiate out through the sides (i.e., side 106), the bottom surface 108, and the top surface 104 thereby illuminating the glyph 102 as described above. Alternatively, the light source 112 can be in location 112D and the glyph 102 is opaque and the key 100 is translucent. The light rays 114A, 114B, and 114C radiate out from key 100 and backlight the glyph 102.

In one embodiment, the light source 112 can be located above the key 100 (i.e., light source location 112A), such that the light source 112A illuminates the top surface 104. The light rays 118A, 118B, and 118C illuminate and reflect off the top surface 104 and the glyph 102. If the top surface 104 and the key 100 are transparent or translucent, light rays directed toward the top surface 104 can also exit through the sides (i.e., side 106) and the bottom 108 of the key 100. For example, the light source is in position 112A, the top surface 104 is opaque, and the glyph 102 and the key 100 are translucent, there is an increase in contrast of glyph 102 as compared to the surrounding opaque top surface 104 when light reflects from the glyph 102 and the top surface 104. Alternatively, the key 100 and the top surface 104 can be opaque and the glyph 102 translucent such that the glyph 102 is illuminated when light reflects off the top surface of the key and the translucent glyph. The opaque top surface 104 allows the glyph 102 to have an increased contrast when light reflects off the glyph 102 compared to when light does not reflect off the glyph 102.

Alternatively, the top surface 104 can be a matt surface and the glyph 102 a smooth surface such that light rays 118A, 118B, and 118C are more efficiently reflected off the glyph 102 than off the top surface 104 increasing the contrast between the glyph 102 and the top surface 104 thus making the glyph 102 more visible to a user. Similarly, a matt glyph 102 and a smooth top surface 104 will also increase the contrast between the glyph 102 and the top surface 104 such that the glyph 102 is more visible to a user.

In another embodiment, the light source 112A can be a color and directing light rays 118A, 118B, and 118C to the top surface 104. The glyph 102 is substantially the same color as the light source 112A and the top surface 104 has a substantially different color than the glyph 102 and the light source 112A. When the light source 112 is off, the glyph 102 has a decreased contrast when compared to the top surface 104 than when the light source 112 is on. For example, the light source 112A can be red and the surface 104 is black and a red glyph 102. The contrast between the red glyph 102 and the black top surface 104 is reduced when the red light source 112 is off than when compared to when the light source 112 is on. In other embodiments, the light source can be located on the side, under, or within the key (i.e., light source locations 112B, 112C, 112D) and the glyph 102 can be a color other than the color of the top surface 104. There is a decrease in contrast between the glyph 102 and the top surface 104 when the light source 112 is off as compared to an increase in contrast between the glyph 102 and the top surface 104 when the light source 112 is on.

In another embodiment, the colors of the glyph 102 and the light source 112 are complimentary. Complimentary colors are colors that are across from each other on a basic red, orange, yellow, green, blue, and violet color wheel. There are three basic pairs of complimentary colors: violet and yellow, blue and orange, and red and green. Color compliments are color opposites and visually exhibit a very high contrast when compared to each other. Other complimentary colors and combinations of colors may also be used.

In one embodiment, the top surface 104 is a color such that when the light source 112 illuminates the glyph 102, the contrast between the top surface 104 and the glyph 102 is increased. For example, when a blue light source 112 is applied to or through an orange glyph 102, the glyph 102 appears brown. Therefore, if the top surface 104 is white when the light source 112 is on, the brown-appearing glyph 102 and the white top surface 104 have an increased contrast as compared to the contrast of the orange glyph 102 to the white top surface 104 when light source 112 is off. Inversely, if the top surface 104 is brown and the light source 112 is on, the brown-appearing glyph 102 and a brown top surface 104 have a decreased contrast when compared to the increased contrast of the orange glyph 102 to the brown top surface 104 when light source 112 is off.

Figure 2:
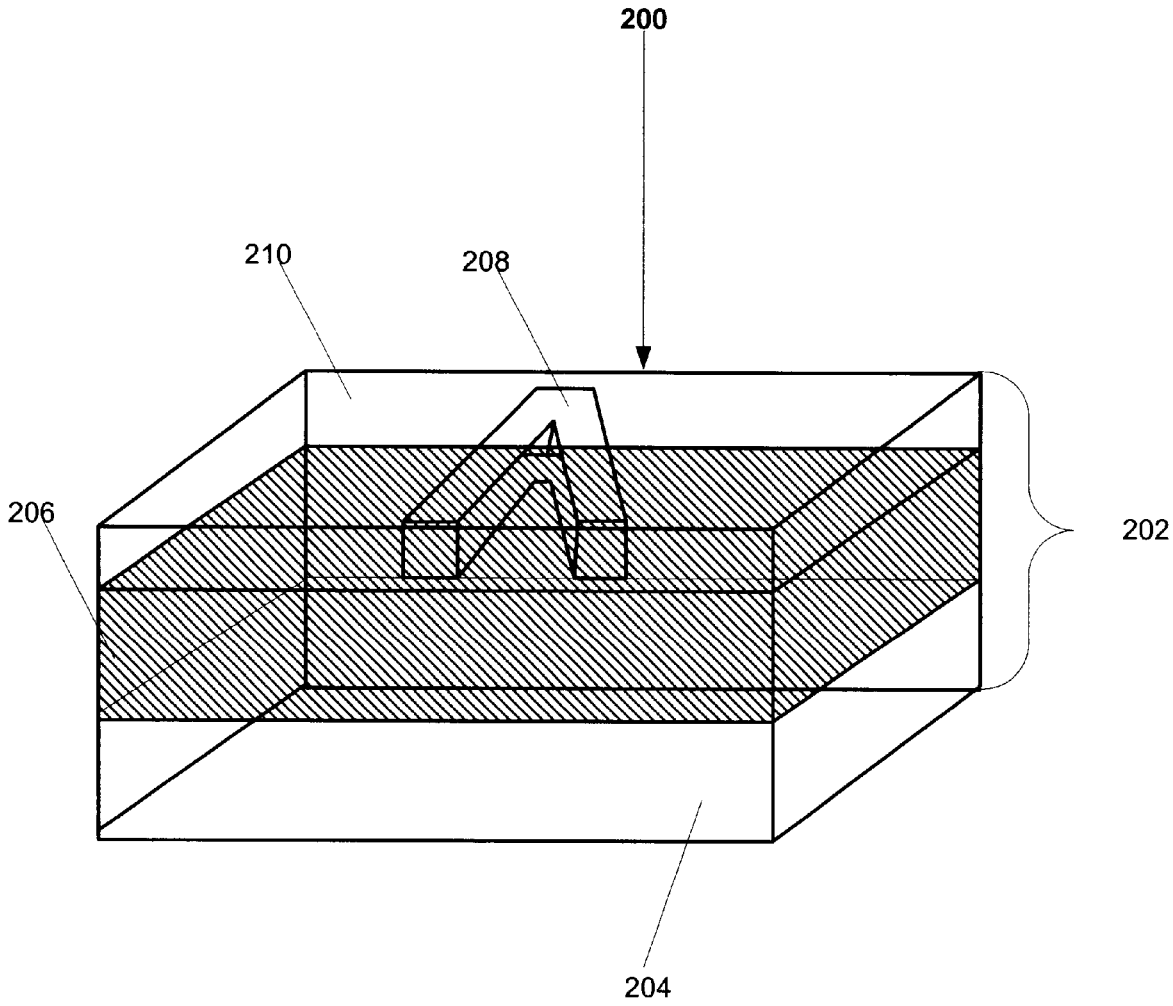
FIG. 2 illustrates a cross-section view of one embodiment of a key.

FIG. 2 illustrates a cross-section view of one embodiment of a key. The key 200 can have multiple layers such as the three layers 204, 206, and 210. Layer 204 is at the bottom of the key 200 and layer 206 is between layers 204 and 210. Layer 210 is the top layer of the key 200. A glyph 208 can be located on the key 200 as described above in FIG. 1.

Each of the layers 204, 206, and 210 can be a color, transparent, translucent, opaque, or combinations thereof. The top layer 210 can also be matt or smooth as described above in FIG. 1. A transparent layer allows light to pass through the layer substantially undiffused. A translucent layer diffuses the light and provides a substantially even distribution of light throughout the layer. An opaque layer reflects or absorbs the light and prevents light from passing through the key.

In one embodiment, layer 204 is transparent, layer 206 is translucent, and the glyph 208 is in the opaque top layer 210. For example, the glyph 208 can be "etched" out of the top layer 210 exposing the translucent layer 206 in the shape of a glyph such that when light passes through the transparent layer 204, out the sides, and upward through the key 200, the light is diffused through the translucent layer 206 and the glyph 208. Because light does not pass through the opaque top layer 210 the glyph 208 is illuminated thereby increasing the contrast between the glyph 208 and the opaque top layer 210. Alternatively, the top layer 210 can be translucent and layer 206 opaque. For example, layer 206 is an opaque white, layer 210 is a translucent blue and glyph 208 is a translucent orange. When a blue light source is directed toward the top surface, light is diffused through the top layer 210 and the glyph 208 making the glyph appear brown and thus increasing the contrast between the glyph 208 and the opaque white top layer 210. In alternative embodiments, the transparent layer 204 can be omitted and/or additional layers (not shown) can be included. Additionally, a side or multiple sides (i.e., side 202) can have an opaque layer (not shown).

Figure 3:
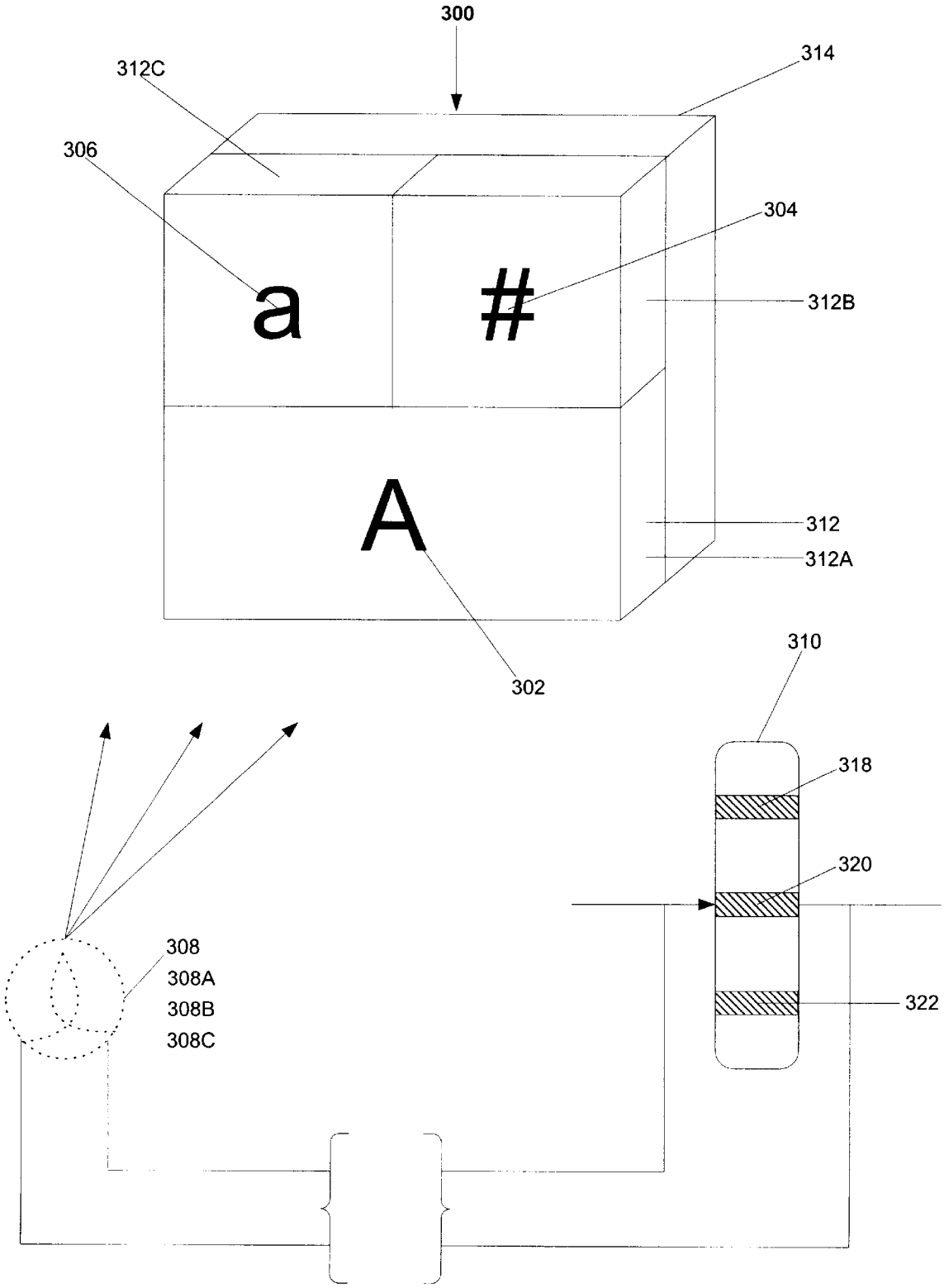
FIG. 3 illustrates one embodiment of a key with multiple glyphs.

FIG. 3 illustrates one embodiment of a key with multiple glyphs. The key 300 includes three glyphs, 302, 304, 306, a backside 314, and portions of the key 312A, 312B, and 312C. The portions of the key 312A, 312B, and 312C can be colored, transparent, translucent, or opaque or any combination thereof. In one embodiment, each glyph is located on a corresponding portion of the key 312 (i.e., 312A, 312B, and 312C) that also corresponds to a selectable function on the key 300. The key 300 can also include multiple layers as described in FIG. 2 above. Alternatively, the portion of the key 312 can correspond to any one or more of the remaining layers as described above. FIG. 3 also includes a light source 308 connected to a light source selector 310. In various embodiments, light source selector 310 can select a characteristic of the light source such as wavelength or intensity. The light source can be of any type or in any one or more of the locations as discussed above in FIG. 1. Selector 310 can include any type of selector known in the art such as, a thumbwheel, a mouse, a trackball, a rocker switch, a touchpoint, another key, voice command, or other input device, or software, or any combination thereof. In one embodiment the selector 310 has selections 318, 320, and 322 that respectively correspond to the glyphs 302, 304, 306 and the glyphs corresponding functions (i.e., "A", "a", "#"). For example, if selection 320 ("A") is made then corresponding glyph 302 is selected. As discussed above, colors, or alternatively, complimentary colors can be used to increase and decrease the contrast of the selected glyphs over the other non-selected glyphs on the key 300.

In one embodiment, the selector 310 is used to select the appropriate light source 308 corresponding to the selected glyph (i.e., 302) such that the glyph's contrast is increased over the non-selected glyphs. For example, glyph 302 is violet and light source 308A is yellow, glyph 304 is green and light source 308B is red, and glyph 306 is orange and light source 308C is blue. To select the green glyph 304, the selector 310 selects a desired function 320 on selector 310 corresponding to the green glyph 304. The selection of the desired function selects the red light source 308B that is complimentary in color to the green glyph 304 causing the glyph 304 to appear dark brown. As a result, there is an increase in contrast between the selected glyph 304 over the remaining non-selected violet and orange glyphs 302 and 306. Similarly, selector 310 set to functions 318 or 322 respectively can select the respective glyphs, 302 and 306. In other embodiments, the light source wavelengths, including wavelengths inside and outside the visible spectrum (i.e., one micrometer to one nanometer), can be used in combination. Further, the glyphs and light sources are not limited to complimentary colors.

In another embodiment, glyph 302 is violet, glyph 304 is green and glyph 306 is orange. If the light source selected is blue, then the violet glyph 302 appears to be blue-violet, the green glyph 304 appears to be blue-green and the orange glyph 306 appears to be dark brown. In comparing the glyphs 302, 304, 306, the contrast of the violet and green glyphs 302 and 304 changes little in comparison to the increase in contrast of the orange glyph 306. If the light source selected is yellow, the violet glyph 302 appears to be dark brown, the green glyph 304 appears to be yellow-green and the orange glyph 306 appears to be yellow-orange. In comparing the glyphs 302, 304, and 306, the contrast of the green and orange glyphs 304 and 306 changes little in comparison to the increase in contrast of the violet glyph 302. Similarly, if the light source selected is red, the violet glyph 302 appears to be purple, the green glyph 304 appears to be dark brown and the orange glyph 306 appears to be red-orange. In comparing the glyphs 302, 304, and 306, the contrast of the violet and orange glyphs 302 and 306 changes little in comparison to the increase in contrast of the green glyph 304. If the light source is off, then none of the glyphs 302, 304, 306 are selected and there is no change in contrast between the glyphs 302, 304, and 306 and no function is selected. Alternatively, there can be a default function represented by a glyph that is more visible when the light source if off than the non-selected glyphs.

Figure 4:
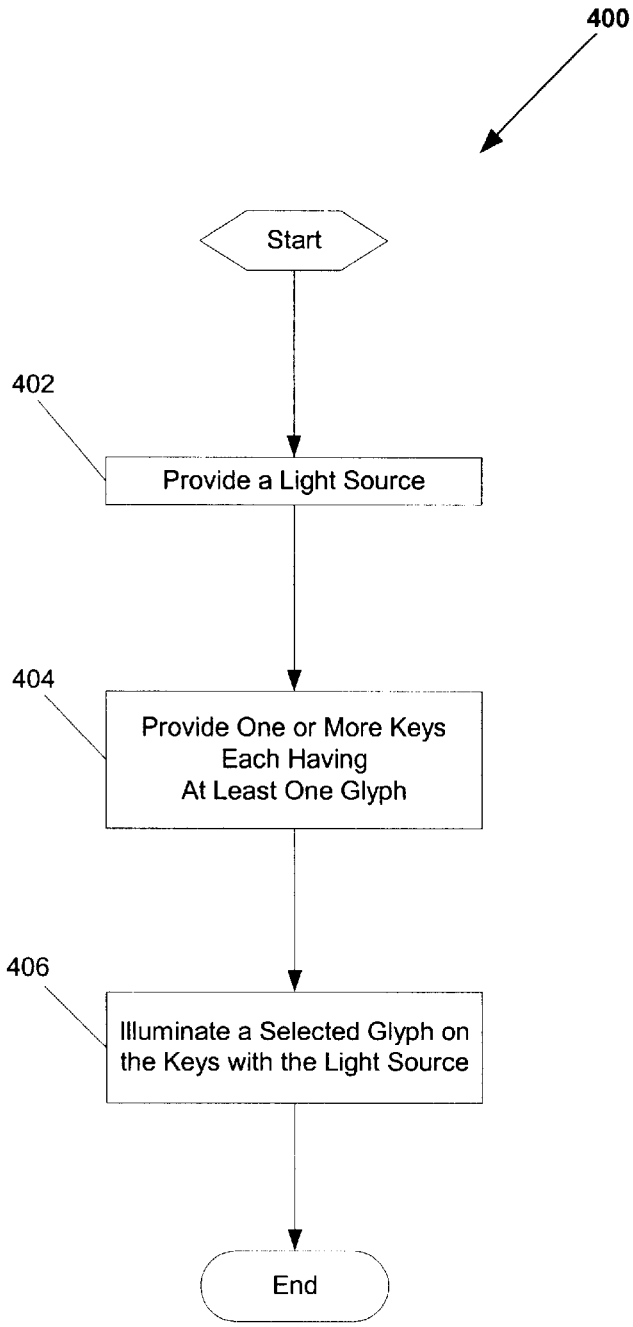
FIG. 4 shows a process flowchart 400 of one embodiment.

FIG. 4 shows a process flowchart 400 of one embodiment. A light source is provided in block 402 that can be of the types and locations or combinations thereof as discussed in FIG. 1 above. One or more keys are provided in block 404, each key has at least one glyph. In order to illuminate the selected glyph in block 406, the light source must be located such that the light source illuminates the key and glyph thereby increasing the contrast of the glyph making it more visible to a user.

Figure 4A:
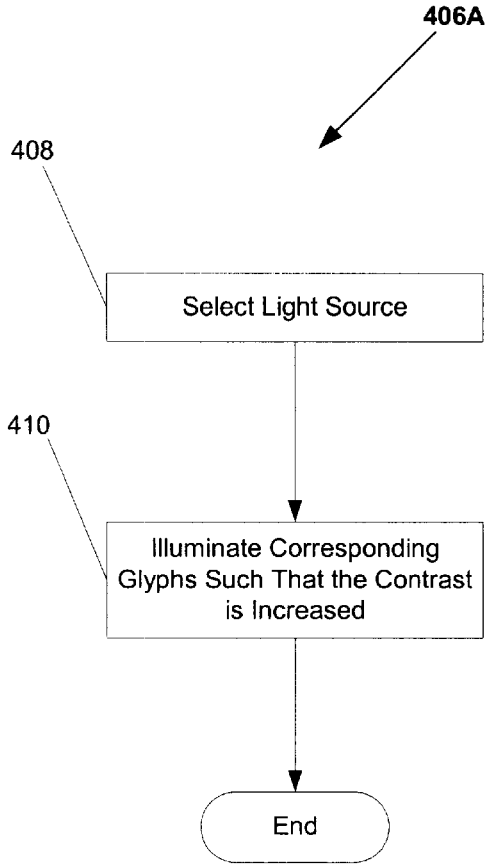

An alternative to illuminating the glyph as described above in block 406 is shown in FIG. 4A. FIG. 4A illustrates a selection of a light source in block 408 such that a specific glyph corresponding to the selected light source increases in contrast with respect to other glyphs in block 410 such as described in FIG. 3 above.

Figure 5:
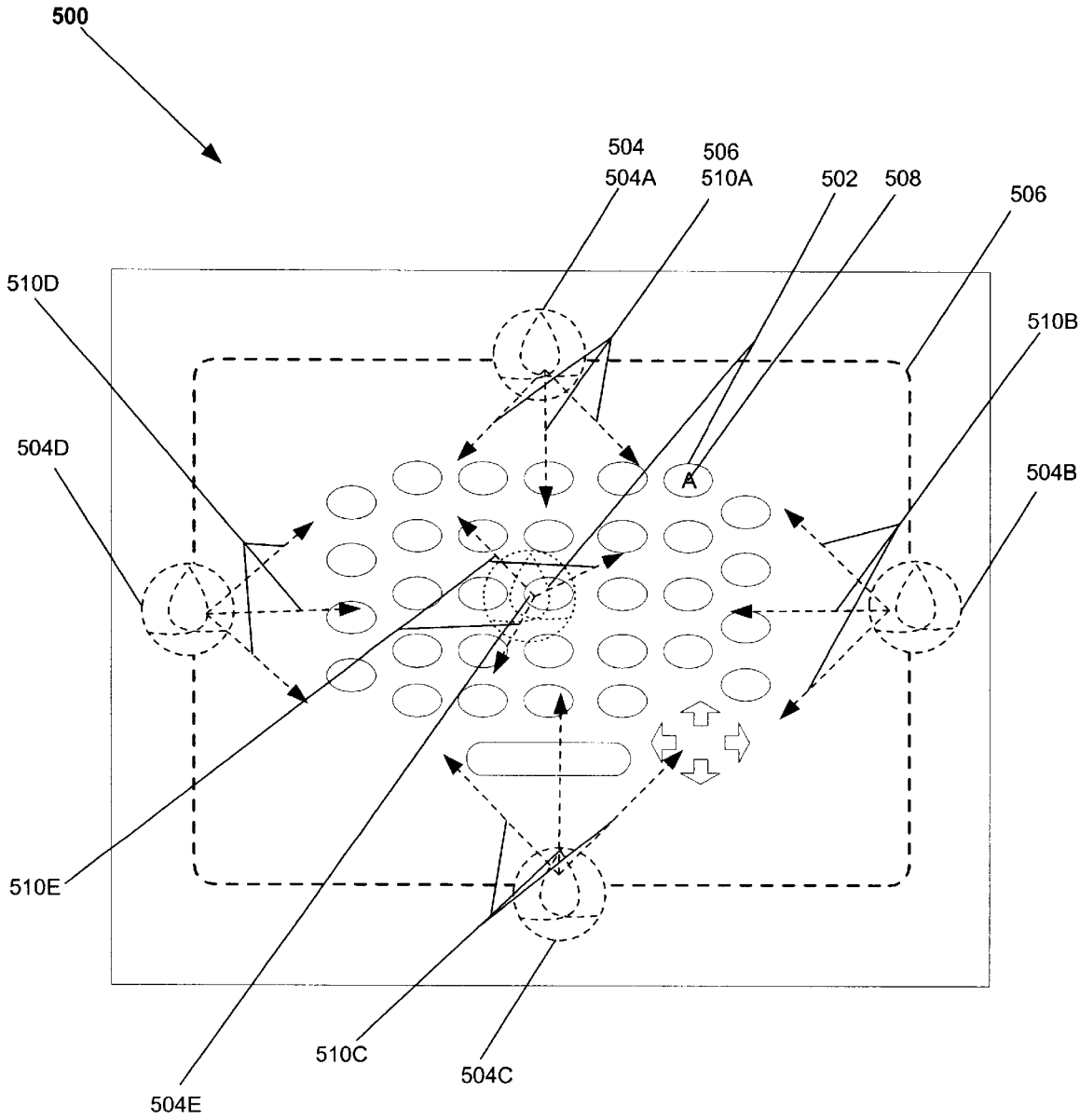
FIG. 5 illustrates lateral illumination of keys on keyboard 500 from the perimeter 506 of the keyboard 500.

FIG. 5 illustrates lateral illumination of keys on keyboard 500 from the perimeter 506 of the keyboard 500. In one embodiment, at least one layer below the top surface of the key is transparent or translucent such that light can be conducted from one key to an adjacent key as described in FIGS. 1 and 2 above. Therefore, the light source may be in any one of the positions shown 504A, 504B, 504C, 504D, 504E, or in any combination thereof. The light rays 510A, 510B, 510C, 510D, are directed onto the keys from the perimeter 506 and conduct laterally through the remaining keys illuminating the key (i.e., key 502) and the glyph (i.e., glyph 508) as described in FIG. 1 above. Alternatively, each of the keys can also include more than one glyph.

In another embodiment a light source 504 is not located on the perimeter but under the keyboard in position 504E. The keys (i.e., key 502) located above the light source 504E can transmit light rays 506E laterally to illuminate adjacent keys and corresponding glyphs. For example, a light source 504E can illuminate the keyboard 500 from below and a light source 504A and 504B can illuminate the keyboard from the perimeter. The keys (i.e., key 502) are illuminated by the selected light source through lateral transmission, as described above, creating an increased contrast of the selected glyphs (i.e., glyph 508) as compared to the non-selected glyphs (not shown). In one embodiment, the perimeter 506 can include an optical layer such that light from one or more light sources (i.e., light sources 504B and 504D) is emitted from the entire perimeter 506 and transmitted laterally through the keys.

Figure 6:
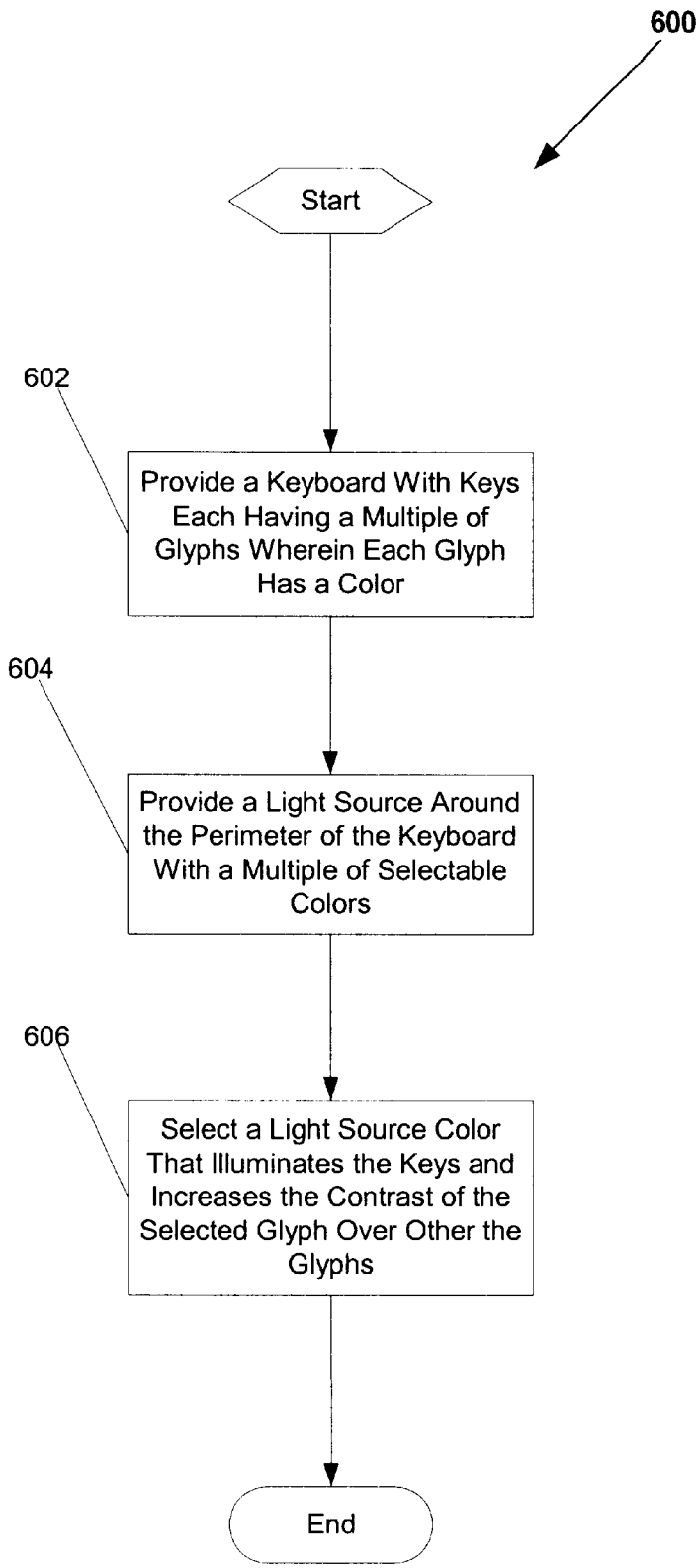
FIG. 6 shows a flow chart of a process for one embodiment.

FIG. 6 shows a flow chart of a process for one embodiment. A keyboard is provided in block 602 with each key having multiple glyphs and each glyph has a color. A light source with multiple of selectable wavelengths corresponding to the glyphs illuminates the keys from the perimeter of the keyboard in block 604 as discussed in FIG. 5 above. One of the selectable wavelengths of the light source 606 can be complimentary to the color of the glyph or any combination of non-complimentary colors that increase the contrast of the selected glyph over the non-selected glyph as discussed in FIG. 3 above. Similarly, the light source selected can be a wavelength outside the visible range, which reacts with fluorescent material in keys and/or glyphs to increase the contrast of the selected glyph as discussed in FIG. 1 above.

Alternatively, the light source can be in any wavelength, intensity, or in any of the locations discussed in FIG. 1 above, such as above the keyboard, below the keyboard, within each key or any combination thereof such that light rays illuminate the keys and increase the contrast of the selected glyphs.

Figure 7:
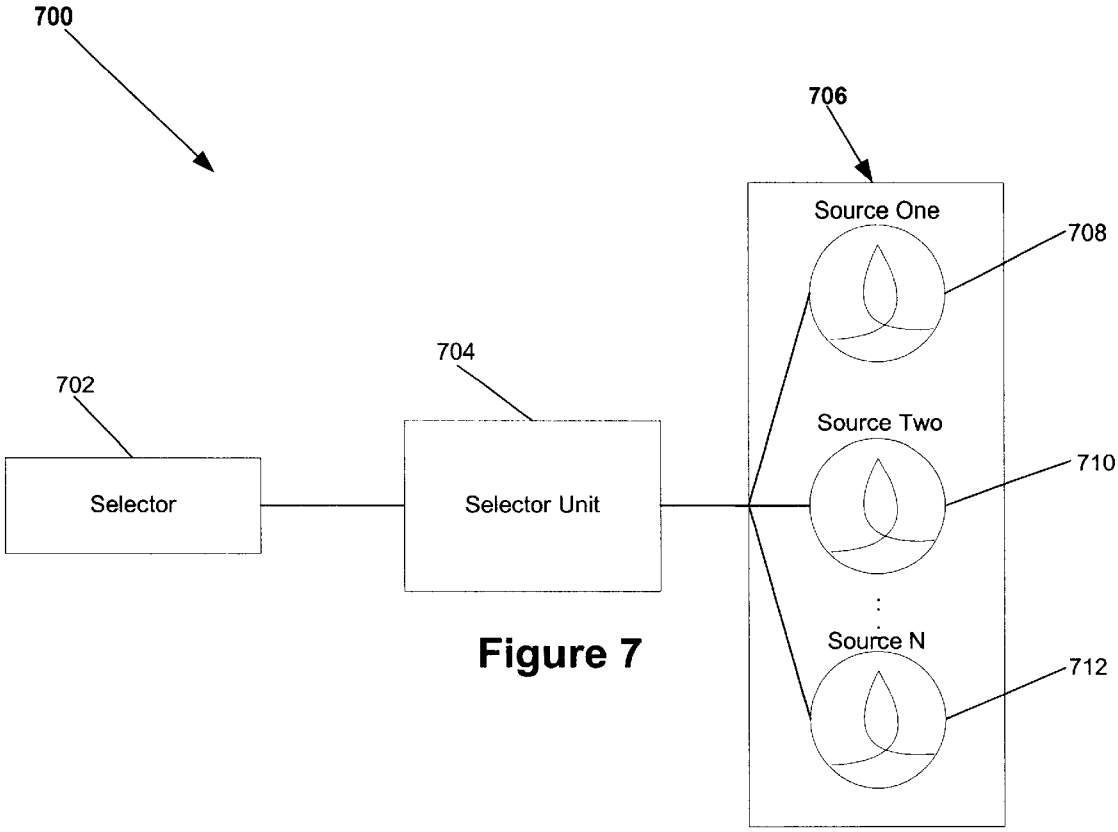
FIG. 7 illustrates one embodiment of a light source selector.

FIG. 7 illustrates one embodiment of a light source selector. The components 700 include a selector 702, a selector unit 704, a light source 706, the light source 706 includes multiple sources such as a source one 708, a source two 710, and up to a source N 712, where N is not restricted to a fixed number of sources. The selector 702 can be any one of the selectors described in FIG. 3 above or any combination thereof.

The selector unit 704 receives an input from the selector 702 and selects, or enables, the light source 706 corresponding with the selected function. The selector unit 704 can be of any type known in the art such as software, a hardware, a microprocessor, a mechanical device (i.e. switch, relay, etc.) or combinations thereof.

The light source 706 is coupled to the selector unit 704 and can be one or more discrete sources as discussed in FIG. 1 above. For example, source one 708 can be a red LED, source two 710 a green LED and source N 712 a blue LED.

Figure 7A:
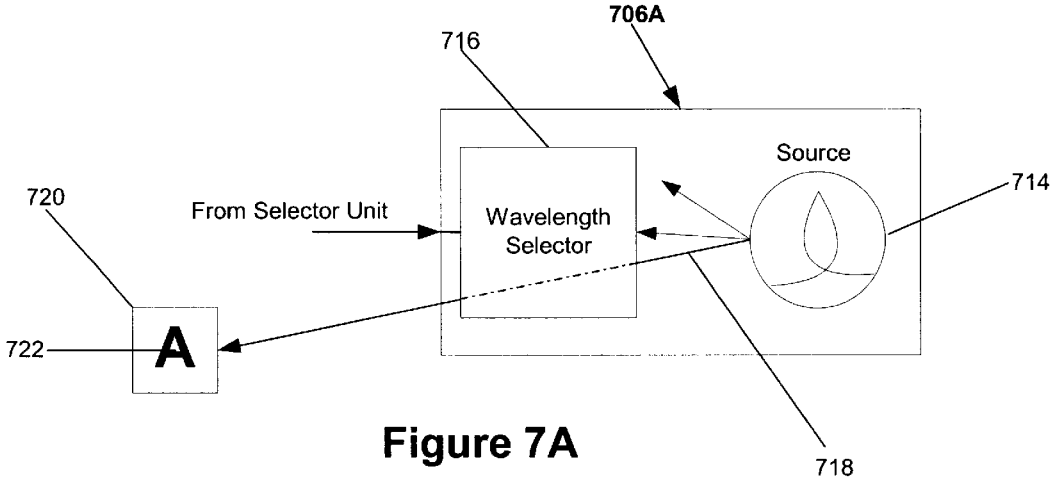
FIG. 7A illustrates an alternative light source 706A.

In another embodiment, FIG. 7A illustrates an alternative light source 706A. Light source 706A includes source 714, wavelength selector 716, and light ray 718. In one embodiment source 714 is a single source. In alternative embodiments source 714 can be multiple sources (not shown) such as described in FIG. 7 above. Wavelength selector 716 can be of any type known in the art such as optical color filters, optical gratings, tunable sources or any combination thereof. In one embodiment source 714 emits light ray 718 of a first wavelength (i.e., white) toward wavelength selector 716, whereupon exiting the wavelength selector 716 the light ray 718 is a second wavelength (i.e., blue) and is directed toward key 720 illuminating glyph 722 as described in FIG. 1 above.

Figure 8:
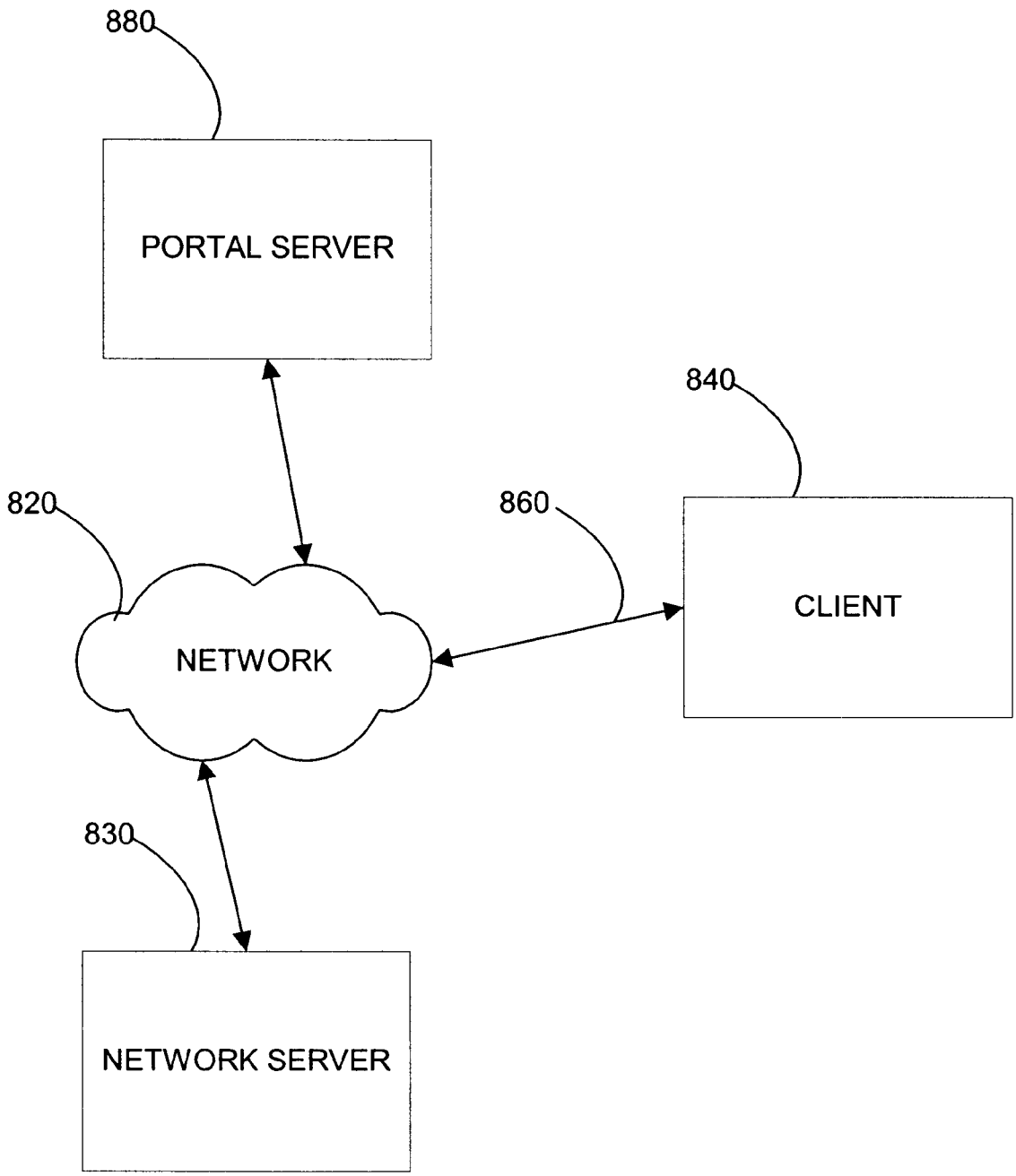
FIG. 8 illustrates one embodiment of a communication network.

Elements of the present invention may be included within a client-server based architecture such as illustrated in FIG. 8. A portal server 880 communicates with clients 840 and other network servers 830 over a network 820 (e.g., the Internet). The network 820 over which the clients 840 and servers 880, 830 transmit and receive data may be comprised of any combination of private (e.g., leased) and/or public communication channels. These may include, for example, Digital Signal ("DS") channels (e.g., DS-3/T-3, DS-1/T1), Synchronous Optical Network ("SONET") channels (e.g., OC-3/STS-3), Integrated Services Digital Network ("ISDN") channels, Digital Subscriber Line ("DSL") channels, cable modem channels and a variety of wireless communication channels including satellite broadcast and cellular channels.

In addition, various networking protocols may be used to support communication across the network 820 including, for example, the Asynchronous Transfer Mode ("ATM"), Ethernet, and Token Ring (at the data-link level); as well as Transmission Control Protocol/Internet Protocol ("TCP/IP"), Internetwork Packet Exchange ("IPX"), AppleTalk and DECnet (at the network/transport level). It should be noted, however, that the principles of the invention are not limited to any particular communication channel or protocol.

The portal server 880 in one embodiment includes a user database for storing various types of user configuration and account data. Users may register and login to the portal server 880 from a client 840 by specifying a user ID and/or password. According to one embodiment, a user connects to the servers 880, 830 via a browser application such as Netscape Navigator™ or Microsoft Internet Explorer™ which communicates via the Hypertext Transfer Protocol (hereinafter "HTTP").

In one embodiment, users may configure the portal server 880 to retrieve and manage specific types of information. For example, a user may configure the portal server 880 to retrieve up-to-date stock quotes for a specified set of stocks (e.g., reflecting the user's portfolio), to collect the weather forecast for the user's hometown, and/or to retrieve recent articles relating to a particular sports franchise. The portal server will then retrieve the specified information from other servers (e.g., server 830) on behalf of the user.

In addition to information retrieval and management, in one embodiment the portal server 880 also provides application services such as email, online scheduling (e.g., appointments, to-do lists, etc), instant messaging, contact management, word processing and a variety of other online services. Users may access these services by logging in to the portal server 880 with a valid user ID and password. In one embodiment, the portal server 880 generates a unique, personalized Web page for each user containing links to all, or a subset of, the information and/or services subscribed to by the user.

Figure 9:
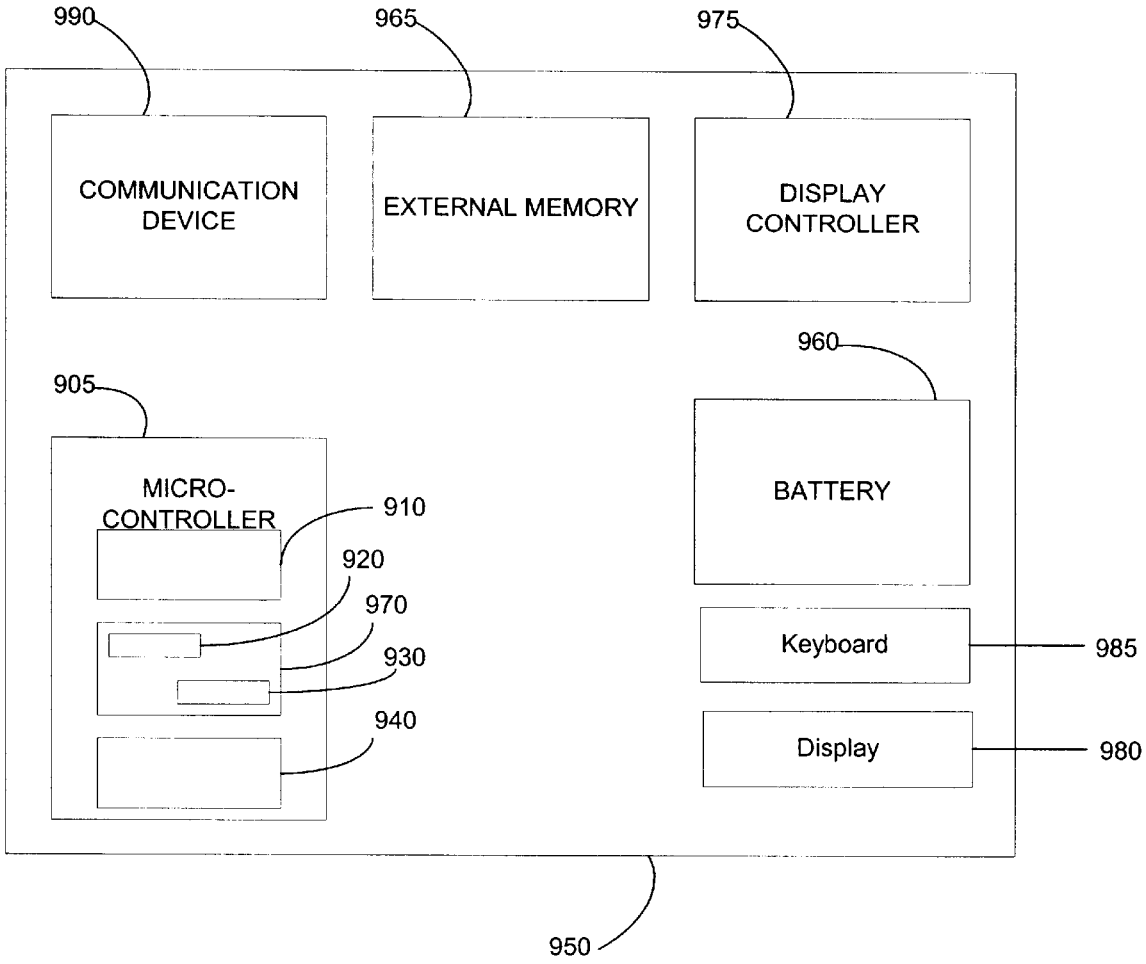
FIG. 9 illustrates one embodiment of a portal device.

As illustrated in FIG. 9, one embodiment of the portal device 950 is comprised generally of a microcontroller 905, an external memory 965, a display controller 975, display 980, keyboard 985, and a battery 960. The external memory 965 may be used to store programs and/or portal data 965 transmitted to the portal device 950 from the portal server 910 (e.g., via client 840). In one embodiment, the external memory 965 is non-volatile memory (e.g., an electrically erasable programmable read only memory ("EEPROM"); a programmable read only memory ("PROM"), etc). Alternatively, the memory 965 may be a volatile memory (e.g., random access memory or "RAM") but the data stored therein may be continually maintained via the battery 960. The battery 960 in one embodiment is a coin cell battery (e.g., of the same type used in portable electronic devices such as calculators and watches). In one embodiment, when the battery power decreases below a threshold level, the portal device 950 will notify the user and/or the portal server 880. The portal server 880 in one embodiment will then automatically send the user a new battery.

The microcontroller 905 of one embodiment is comprised of a central processing unit ("CPU") 910, a read only memory ("ROM") 970, and a scratchpad RAM 940. The ROM 970 is further comprised of an interpreter module 920 and a toolbox module 930.

The toolbox module 930 of the ROM 970 contains a set of toolbox routines for processing data, text and graphics on the portal device 950. These routines include drawing text and graphics on the portal device's display 930, decompressing data transmitted from the portal server 910, reproducing audio on the portal device 950, and performing various input/output and communication functions (e.g., transmitting/receiving data over the client link 860). A variety of additional portal device functions may be included within the toolbox 930 while still complying with the underlying principles of the invention.

In one embodiment, microprograms and portal data 960 are transmitted from the portal server 880 to the external memory 965 of the portal device via a communication interface 990 under control of the CPU 910. Various communication interfaces 990 may be employed without departing from the underlying principles of the invention including, for example, a Universal Serial Bus ("USB") interface or a serial communication ("serial") interface. The microprograms in one embodiment are comprised of compact, interpreted instructions known as "bytecodes," which are converted into native code by the interpreter module 920 before being executed by the CPU 910. One of the benefits of this configuration is that when the microcontroller/CPU portion of the portal device 950 is upgraded (e.g., to a faster and/or less expensive model), only the interpreter module 920 and toolbox 930 of the ROM needs to be rewritten to interpret the currently existing bytecodes for the new microcontroller/CPU. In addition, this configuration allows portal devices 950 with different CPUs to coexist and execute the same microprograms. Moreover, programming frequently-used routines in the ROM toolbox module 930 reduces the size of microprograms stored in the external memory 965, thereby conserving memory and bandwidth over the client link 860. In one embodiment, new interpreter modules 920 and/or toolbox routines 930 may be developed to execute the same microprograms on cellular phones, personal information managers ("PIMs"), or any other device with a CPU and memory.

One embodiment of the ROM 970 may be comprised of interpreted code as well as native code written specifically for the microcontroller CPU 905. More particularly, some toolbox routines may be written as interpreted code (as indicated by the arrow between the toolbox 930 and the interpreter module 920) to conserve memory and bandwidth for the same reasons described above with respect to microprograms. Moreover, in one embodiment, data and microprograms stored in external memory 965 may be configured to override older versions of data/microprograms stored in the ROM 970 (e.g., in the ROM toolbox 930).

The portal device 950 may communicate with the portal server 880 (discussed above) using various RF communication techniques. For example, in one particular embodiment, the portal device 950 transmits and receives data to/from a cellular network via the cellular digital packet data ("CDPD") standard. As it is known in the art, the CDPD standard is a digital wireless standard that is deployed as an enhancement to the existing analog cellular network. It provides a packet overlay onto the AMPS network and moves data at 19.2 Kbps over continuously-changing unused intervals in standard voice channels. Accordingly, this embodiment of the portal device is capable of exploiting normally unused bandwidth on a nation-wide, analog cellular network. Embodiments of the portal device may also be configured to transmit/receive data using a variety of other communication standards including 2-way paging standards and third generation ("3G") wireless standards (e.g., UTMS, CDMA 2000, NTT DoCoMo, . . . etc).

As indicated in FIG. 9, one embodiment of the portal device 950, the CPU 905 employs a 32-bit RISC-based microprocessor such as an ARM processor. As is known in the art, ARM processors are widely used in PDAs, cell phones and a variety of other wireless devices. It should be noted, however, that various other hardware and software (and/or firmware) architectures may be used for the portal device 950 while still complying with the underlying principles of the invention.

The portal device 950 can also include a display and a keyboard. The keyboard can include keys and light sources such as described above in FIGS. 1, 2, 3, 5, and 7.

Embodiments of the invention may include various steps as set forth above. The steps may be embodied in machine-executable instructions. The instructions can be used to cause a general-purpose or special-purpose processor to perform certain steps. Alternatively, these steps may be performed by specific hardware components that contain hardwired logic for performing the steps, or by any combination of programmed computer components and custom hardware components.

Elements of the present invention may also be provided as a machine-readable medium for storing the machine-executable instructions. The machine-readable medium may include, but is not limited to, floppy diskettes, optical disks, CD-ROMs, and magneto-optical disks, ROMs, RAMs, EPROMs, EEPROMs, magnetic or optical cards, propagation media or other type of media/machine-readable medium suitable for storing electronic instructions. For example, the present invention may be downloaded as a computer program which may be transferred from a remote computer (e.g., a server) to a requesting computer (e.g., a client) by way of data signals embodied in a carrier wave or other propagation medium via a communication link (e.g., a modem or network connection).

Figure 10:
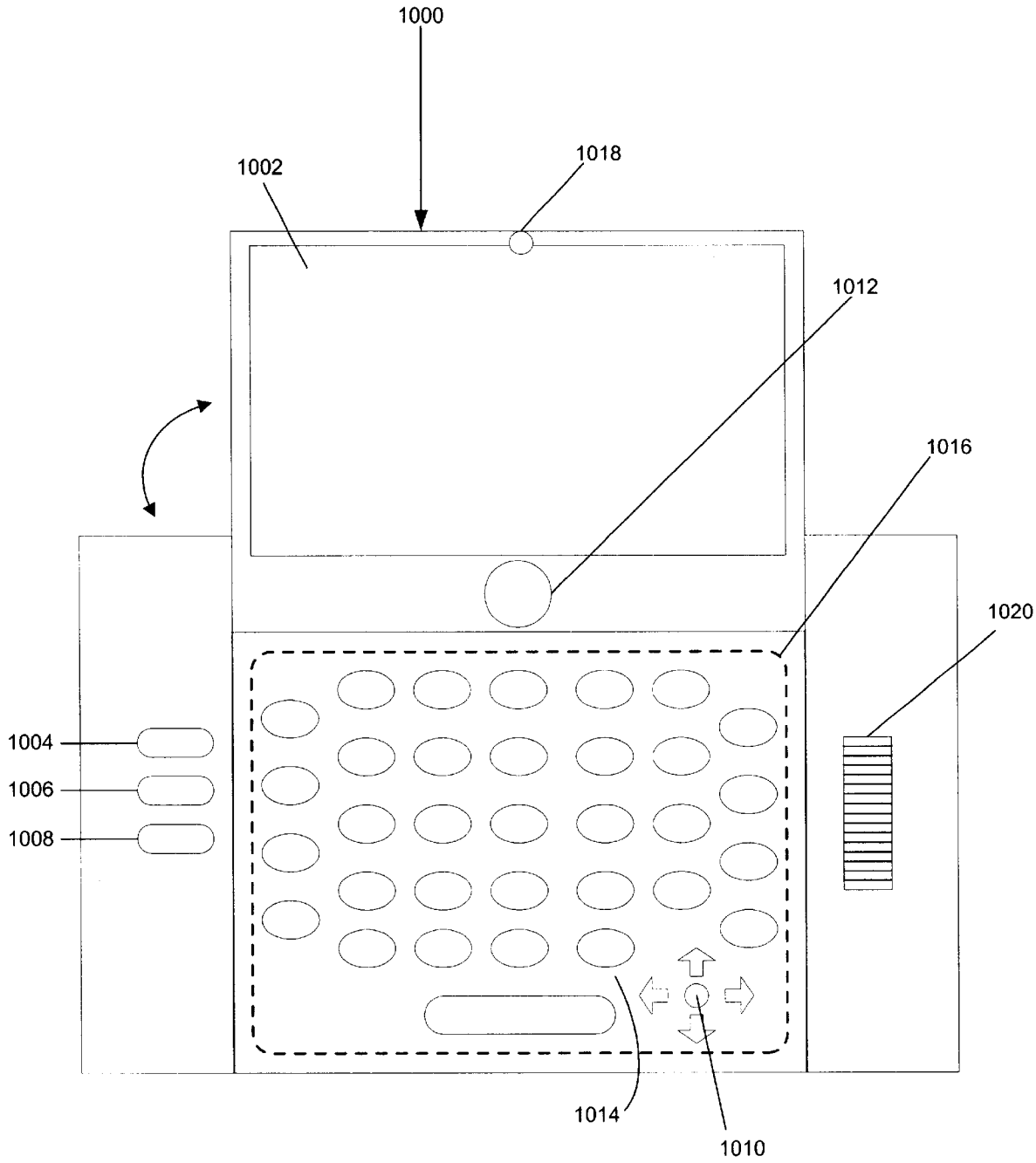
FIG. 10 illustrates an embodiment of a handheld keyboard and display device such as may be used as the portal device of FIG. 9.

FIG. 10 illustrates an embodiment of a handheld keyboard and display device such as may be used as the portal device of FIG. 9. The handheld keyboard and display device 1000 can also include additional user interface devices such as a pointing device, selection buttons 1004, 1006, 1008 and other user interface devices such as joysticks, mice, trackballs, or trackpoint 1010.

In one embodiment, the display 1002 rotates about a pivot 1012. For example, FIG. 10 shows one embodiment of the keyboard and display device in the open position so that the keyboard 1014 is accessible. When the display 1002 is rotated 180 degrees about the pivot 1012, to the closed position, the keyboard 1014 is substantially covered.

In one embodiment, the display 1002 is a liquid crystal display, or other similar monochrome or color display devices. The display 1002 can also include a scratch resistant display surface such as glass or polycarbonate or other scratch resistant coating or outer layers as are known in the art. In one embodiment, the display also includes a removable transparent cover to protect the display screen. The transparent cover can also be a disposable cover. In one embodiment, the display 1002 can also include a touch screen.

The keyboard 1014 includes keys with glyphs and light sources as described in FIGS. 1, 2, 3, 5, and 7 above. Thumbwheel 1020 is a light source selector and selects a keyboard function by selecting a corresponding light source to illuminate the keys. Light source 1016 is an optical layer around the perimeter of the keyboard 1014 as discussed above in FIG. 5. Light source 1016 laterally illuminates the perimeter keys, which transmits light to adjacent keys highlighting the glyphs corresponding to a selected function. The light source and light source selector can be any one of the types, in any position or combination thereof as discussed in FIG. 1 above.

Throughout the foregoing description, for the purposes of explanation, numerous specific details were set forth in order to provide a thorough understanding of the invention. It will be apparent, however, to one skilled in the art that the invention may be practiced without some of these specific details. For example, while the system described above employs a single portal server 110, alternative embodiments of the invention may include numerous different servers (e.g., database servers, web servers, etc), and/or mirrored servers distributed across a network. Moreover, while the embodiments described above focus on a portal device, which executes interpreted code (e.g., Java byte codes), the principles of the invention may also be implemented on devices, which execute non-interpreted code. Accordingly, the scope and spirit of the invention should be judged in terms of the claims that follow.

What is claimed is:

1. An apparatus comprising:

first key;

a first non-opaque glyph of a first color disposed on said first key;

a second non-opaque glyph of a second color disposed on said first key;

a light source oriented towards the first key, the light source capable of providing light of a third color or a fourth color, the third color being relatively closer to a complementary color to said first color than to said second color, and the fourth color being relatively closer to a complementary color to said second color than to said first color; and a light source selector to select between said third color and said fourth color to increase contrast between said first glyph and said second glyph.

2. The apparatus as recited in claim 1, wherein said light source selector selects either said third color or said fourth color responsive to a selection of a function associated with said second glyph or said first glyph.

3. The apparatus as recited in claim 1, wherein regions of the first key not comprising a glyph are white.

4. The apparatus as recited in claim 1, wherein regions of the first key not comprising a glyph are black.

5. The apparatus as recited in claim 1, wherein the first key is translucent.

6. The apparatus as recited in claim 5, wherein said first and second glyphs on the first key are transparent.

7. The apparatus as recited in claim 5, wherein said first and second glyphs on the first key are translucent.

8. The apparatus as recited in claim 1,wherein the first key is transparent.

9. The apparatus as recited in claim 8, wherein said first and second glyphs on the first key are translucent.

10. The apparatus as recited in claim 1, further comprising:

a third non-opaque glyph of a fifth color disposed on said first key;

wherein the light source is capable of providing light of a sixth color, the sixth color being relatively closer to a complementary color to said fifth color than to said first color or said second color, the light source selector to select between said third color, said fourth color and said sixth color to increase contrast between said first glyph, said second glyph and said third glyph.

11. The apparatus as recited in claim 10, wherein the glyphs on two or more of the plurality of keys are transparent.

12. The apparatus as recited in claim 10, wherein the first glyph, second glyph and third glyph are translucent.

13. The apparatus as recited in claim 1 wherein the light of the third color is complementary to the light of the first color and wherein the light of the fourth color is complementary to the light of the second color.

14. The apparatus as recited in claim 1 wherein the selected type of light decreases the visual contrast between a corresponding glyph and the remainder of the key over the visual contrast between a non-corresponding glyph and the remainder of the key.

15. The apparatus as recited in claim 14, wherein the selected type of light is of a complementary color to the color of the corresponding glyph.

16. The apparatus as recited in claim 1 wherein the selected wavelength of the light source decreases the visual contrast between a glyph corresponding to the type of light selected and the remainder of the key over the visual contrast between a non-corresponding glyph and the remainder of the key.

17. The apparatus as recited in claim 1, wherein the light source is a light emitting diode ("LED").

18. The apparatus as recited in claim 1, wherein the light source is at least one of a group consisting of: a fluorescent light source, a laser light source, an incandescent light source, an ultraviolet light source, or an infrared light source.

19. The apparatus as recited in claim 1, wherein the light source is under the first key.

20. The apparatus as recited in claim 1, wherein the light source is above the first key.

21. The apparatus as recited in claim 1, wherein the light source is toward a side of the first key.

22. The apparatus as recited in claim 1, wherein the light source is located inside the first key.

23. The apparatus as recited in claim 1 further comprising:

a plurality of additional keys forming a keyboard.

24. The apparatus as recited in claim 1, wherein the light source selector is a second key.

25. The apparatus as recited in claim 1 wherein the light source selector is voice activated.

26. The apparatus as recited in claim 1 wherein the light source selector is a portion of a touch-screen.

27. The apparatus as recited in claim 1 wherein the light source selector is implemented in software.

28. The apparatus as recited in claim 1, wherein the first glyph and the second glyph are either symbols, emblems, marks, figures, patterns, characters, letters, digits, or punctuation marks.

29. A method comprising:

providing a key wherein the key includes a first non-opaque glyph of a first color and a second non-opaque glyph of a second color; and providing a light source oriented towards the first key, the light source capable of providing light of a third color or a fourth color, the third color being relatively closer to a complementary color to said first color than to said second color, and the fourth color being relatively closer to a complementary color to said second color than to said first color; and selecting between said third color and said fourth color to increase contrast between said first glyph and said second glyph.

30. The method as recited in claim 29, wherein said third color or said fourth color are selected responsive to a selection of a function associated with said second glyph or said first glyph.

31. The method as recited in claim 29 wherein selection of said third color causes the first glyph to have an increased contrast when compared to the second glyph.

32. The method as recited in claim 29 wherein selection of said third color causes the second glyph to have a decreased contrast when compared to the first glyph.

33. The method as recited in claim 30, wherein the third color is complementary in color to the first color and the fourth color is complementary to the second color.

34. An apparatus comprising:

a keyboard having a perimeter and comprising a plurality of keys at least one of the plurality of keys having a first non-opaque glyph of a first color and a second non-opaque glyph of a second color disposed thereon;

a light source oriented towards the first key, the light source capable of providing light of a third color or a fourth color, the third color being relatively closer to a complementary color to said first color than to said second color, and the fourth color being relatively closer to a complementary color to said second color than to said first color a light source to provide light of a third color or a fourth color, the third color being relatively closer to a complementary color to said first color than to said second color, and the fourth color being relatively closer to a complementary color to said second color than to said first color, wherein the light source is located on or outside of the perimeter of the keyboard; and a glyph selector communicatively coupled to the light source to select between said third color and said fourth color to increase contrast between said first glyph and said second glyph.

35. The apparatus as recited in claim 34 wherein a light ray from the light source is substantially conducted laterally from the perimeter of the keyboard through at least one side of at least one of the plurality of keys.

36. The apparatus as recited in claim 34, wherein a light ray from the light source is substantially conducted laterally through a first key of the keyboard to a second key of the keyboard.

37. An apparatus comprising:

a first key;

a first non-opaque region of a first color disposed on said first key;

a second non-opaque region of a second color disposed on said first key;

a light source oriented towards the first key, the light source capable of providing light of a third color or a fourth color the third color being relatively closer to a complementary color to said first color than to said second color, and the fourth color being relatively closer to a complementary color to said second color than to said first color; and a light source selector to select between said third color and said fourth color to increase contrast between said first region and said second region.

38. The apparatus as in claim 37 further comprising:

a first glyph disposed within said first region; and a second glyph disposed within said second region.

39. The apparatus as in claim 38 wherein said first glyph and said second glyph are opaque.

* * * * *